United States Patent [19]

Franz

[11] 3,945,174

[45] Mar. 23, 1976

[54] APPARATUS FOR CAPPING AND CONTROLLING LEVEL OF FLUID IN FLEXIBLE CONTAINERS OR BOTTLES

[76] Inventor: Henry H. Franz, 3201 Falls Cliff Road, Baltimore, Md. 21211

[22] Filed: May 7, 1975

[21] Appl. No.: 575,349

[52] U.S. Cl. ..... 53/289; 53/314; 53/317

[51] Int. Cl.[2] ..... B65B 3/24; B65B 7/28; B67B 3/20

[58] Field of Search ..... 53/317, 313, 329, 331.5, 53/314, 124 B, 124 CC, 124 R, 281, 289, 282

[56] References Cited

UNITED STATES PATENTS

| | | | |
|---|---|---|---|
| 2,312,288 | 2/1943 | Schmutzer et al. | 53/281 X |
| 2,909,879 | 10/1959 | Hohl et al. | 53/331.5 |
| 3,435,587 | 4/1969 | Weller | 53/331.5 X |
| 3,457,694 | 7/1969 | Tatibana | 53/39 |
| 3,491,803 | 1/1970 | Galik | 53/282 X |
| 3,590,557 | 7/1971 | Vogel | 53/329 |
| 3,674,060 | 7/1972 | Ruekberg | 53/281 X |

FOREIGN PATENTS OR APPLICATIONS

| | | | |
|---|---|---|---|
| 7,318 | 3/1914 | United Kingdom | 53/317 |

*Primary Examiner*—Travis S. McGehee
*Assistant Examiner*—Horace M. Culver
*Attorney, Agent, or Firm*—Kemon, Palmer & Estabrook

[57] ABSTRACT

An apparatus for capping a flexible container having a predetermined amount of fluid therein wherein a member is provided for engaging and compressing an area of said flexible container during the capping operation. The member, in compressing said container, causes the liquid to be raised or elevated in the container and held closer to the top thereof while the cap or closure is being tightened upon the container. The seal of the cap or closure member is such that air cannot reenter the container and the liquid will remain at the elevated position within the container.

3 Claims, 2 Drawing Figures

Fig. 1
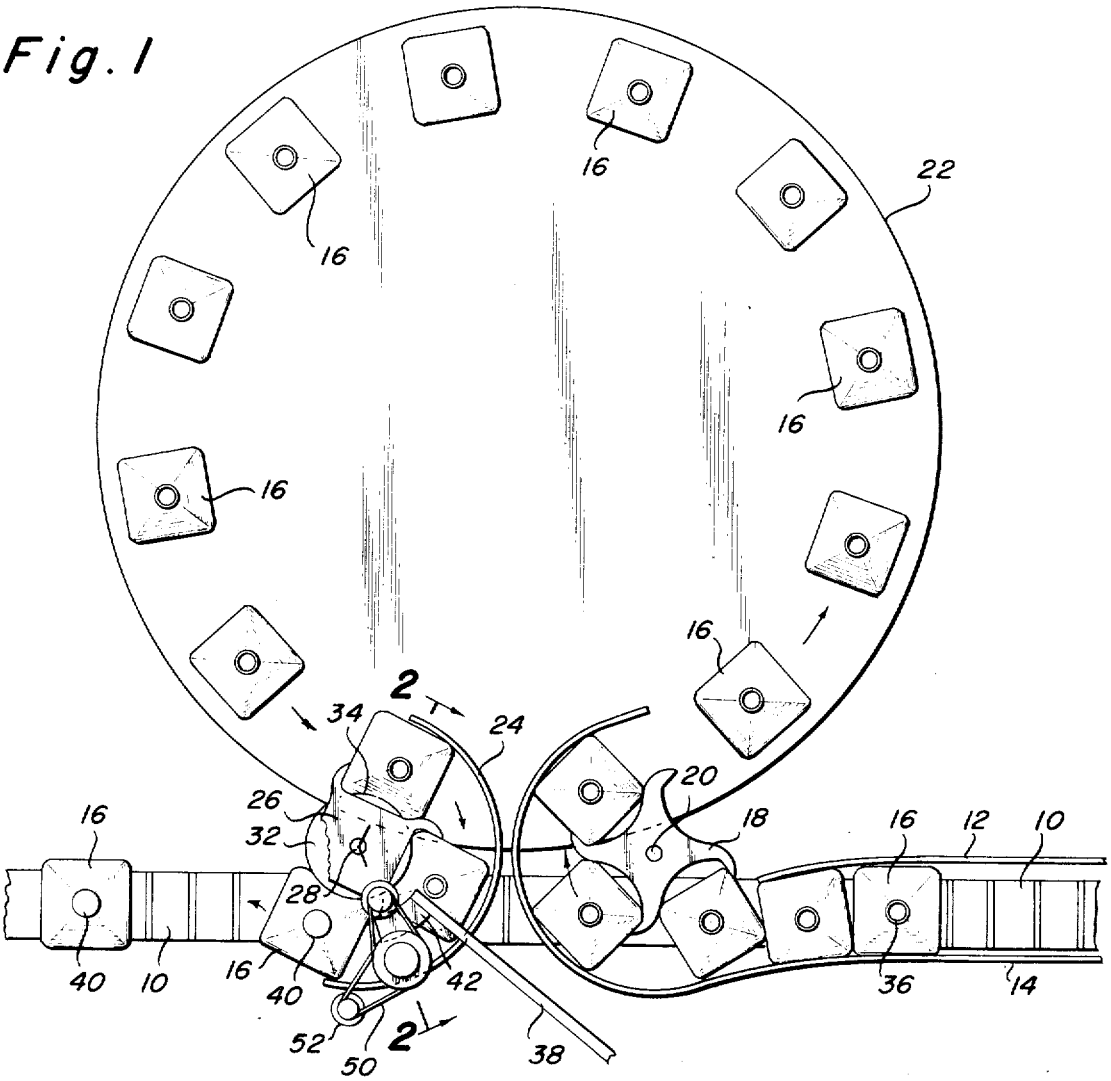
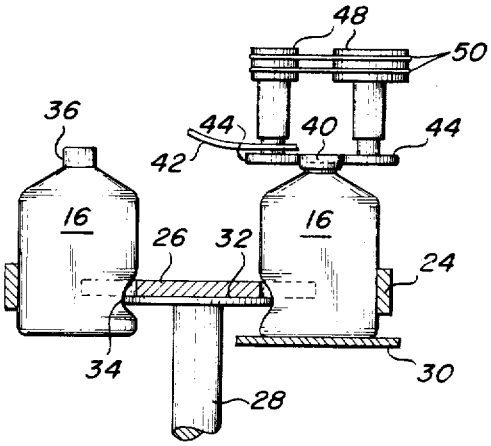
Fig. 2

APPARATUS FOR CAPPING AND CONTROLLING LEVEL OF FLUID IN FLEXIBLE CONTAINERS OR BOTTLES

BACKGROUND OF THE INVENTION

The present invention is directed broadly to an apparatus for handling fluent material and more specifically to the capping of flexible containers having a predetermined amount of fluid therein. The invention is more particularly directed to the compressing or squeezing of the flexible containers to cause the liquid to be raised or elevated therein contemporaneous with the placing of a cap or closure upon each container and the tightening of said cap or closure.

In the milk bottling industry the conventional milk bottle has been replaced by a wax-coated paper carton which in many instances is of a half gallon and gallon size. Such containers, in more recent times, have been molded from an inexpensive plastic material with the end product being a relatively thin flexible plastic container or bottle.

These containers are usually molded in relatively large batches and after the molding operation they are placed in storage for cooling and shrinking. The material used in molding such containers may be such that one batch will shrink more than another batch of containers during the cooling period. This raises the situation that while each and every container will hold a gallon of liquid one batch of containers may not have shrunk as much as another batch and thus are readily capable of holding more than a gallon of liquid.

Thus in the filling of the various batches of the containers with a liquid, such as milk, one batch of containers will appear to be full while another batch would appear not to be completely filled yet both batches of containers would contain a gallon of milk. The public will avoid purchasing the containers that are not completely filled on the assumption, false though it may be, that said containers do not contain a full gallon of milk. Thus the store merchant soon finds that he has on hand a number of containers of milk that appear to be in short supply and as such have not been purchased by the public. While the foregoing situation may be remedied by filling each and every container to the top, so as to present a uniform picture, even though some containers would have more than a gallon of milk therein, the cost of such an operation would fall upon the bottling operator.

SUMMARY OF THE INVENTION

The present invention is directed to the concept of providing apparatus for engaging a flexible container having a predetermined amount of liquid therein so as to compress or squeeze said container. Such a compressing or squeezing will raise or elevate the level of the liquid in the container at the time that a cap or closure is being placed upon and secured to said container. Upon securing the cap or closure upon the container the seal of said cap closure will prevent air from reentering the container so that the liquid will be retained at its raised or elevated position within the container. The raising or elevating of the liquid will permit the use of containers which might have a variance between one another as far as volumetric capacity is concerned. Thus by raising or elevating the liquid within the flexible containers to a certain point the various containers will have a substantially uniform level of liquid therein and thus present a uniform appearance.

The apparatus employed for compressing or squeezing the plastic container is capable of adjustment or it may be of varying size so that the degree of compressing or squeezing of said containers may be controlled.

BRIEF DESCRIPTION OF THE DRAWING

FIG. 1 is a plan view of a portion of a container filling apparatus, the reservoir and filling valves have been omitted in the interest of clarity and showing the present invention engaging a container during the capping or closure applying operation; and FIG. 2 is a vertical sectional view of the capping and container engaging apparatus, the view being taken on the line 2—2 of FIG. 1.

DESCRIPTION OF THE PREFERRED EMBODIMENT

Referring to the drawing there is shown in FIG. 1 a conveyor 10 which is provided with an inner guide rail 12 and an outer guide rail 14 to insure the proper delivery of flexible containers 16 to a propelling starwheel 18 which is connected to and driven by a rotatable shaft 20. The outer guide rail 14 terminates in an inturned arcuate segment which facilitates the movement and delivery of the flexible containers 16 by the starwheel 18 to a rotating turret 22.

The rotating turret 22 is of a conventional type in a container-filling operation as it is provided with the usual posts and pedestals, not shown, for receiving from the starwheel 18 the flexible containers 16 which in turn elevate said containers 16 through suitable cam members, not shown, associated with the turret 22. As the turret 22 continues to rotate the containers would be elevated into engagement with a conventional filling valve carried by a reservoir, not shown, so that the contents of said reservoir could be delivered to the containers 16. Upon the filling of the containers they are withdrawn from the filling valves upon the continued rotating movement of the turret 22 and are then delivered to a cap or closure applying station A, FIG. 1.

The closure applying station A is provided with an arcuate shaped guide rail 24 which is positioned to receive the flexible containers 16 from the rotating turret 22. The guide rail 24 has associated therewith a rotating starwheel 26 which is connected to and driven by a shaft 28 for the purpose of engaging and propelling the flexible containers 16 through the arcuate path as defined by the guide rail 24. The shaft 28 may be rotated by any suitable means, not shown, in order to drive the starwheel 26 for the purpose of propelling the flexible containers 16 through the cap or closure applying station A. The starwheel 26 and the guide rail 24 have associated therewith a table or platform 30, FIG. 2, over which the flexible containers 16 are moved by the propelling starwheel 26 as said flexible containers leave the rotating turret 22 and move through the cap or closure applying station A.

The rotating shaft 28 has secured to its upper end portion, beneath the starwheel 26, a flat disc member 32 whose diameter is such that the peripheral portion of the disc will project outwardly beyond certain areas of the starwheel for the purpose of engaging a side or surface of the flexible containers as they move up to and through the cap applying station A. The peripheral portion 34 of the disc member 32, FIG. 1, in engaging a surface or side of the flexible containers 16 causes said containers to be compressed or squeezed at the particular area by depressing same inwardly which action causes a fluid, such as milk, to be raised or elevated towards the discharge neck or aperture 36 of said flexible container 16. The disc member 32 remains in engagement with the flexible containers 16 for the purpose of depressing a side or surface of said containers during the entire time that the containers are engaged by the propelling starwheel 26 and are moving through the cap or closure applying station A. The degree to which the side or surface of the flexible containers 16 are to be indented or compressed for the purpose of raising or elevating the fluid level of the contents will of course determine the size of the disc 32 that is to be utilized. The starwheel 26 and disc 32 are readily removed from the upper end portion of the rotating shaft 28 so that discs of varying diameter may be employed in conjunction with the starwheel 26 and in this manner the degree to which the flexible container will be compressed or squeezed will be determined by the size of the disc member 32.

As the flexible containers 16 are propelled by the starwheel 26 along the guide rail 24 and over the table or platform 30 with a side or surface of said container being indented or compressed by the disc member 32 the discharge spout or neck portion 36 of each container 16 will pass under the discharge end of a cap supply chute 38. The neck portion 36 of each container 16 will engage a cap or closure member 40 at the discharge end of the chute so that said cap or closure will drop onto said neck portion and will then pass under a cap guide member 42 where the cap will be properly positioned upon the neck portion 36 of the container 16. Upon the continued movement of the flexible container 16 over the table or platform 30 under the action of the propelling starwheel 26 the container with the cap or closure member 40 positioned upon the neck portion 36 will move between a pair of coacting rollers 44, FIG. 2, of the cap applying device. The rollers 44 are carried on the lower ends of shafts 46 with the upper ends of said shafts being provided with suitable drive pulleys 48 around which are entrained belts 50 that are driven by a suitable motor 52. The rotation of the pulleys 48 will cause the rollers 44 to be driven in order to screw the cap or closure member 40 onto the neck portion 36 of the flexible containers 16.

The cap or closure members 40 are provided with a suitable sealing means, not shown, to prevent the reentry of air into the flexible containers 16 so that the level or height of the liquid in the flexible containers, as created by the engagement of the disc member 32 with the side or surface of the containers, will be maintained until such time as the cap or closure member 40 is removed from the container. After the cap or closure member 40 has been applied to the flexible container 16 the continued rotation of the starwheel 26 will move the container off of the table or platform 30 and onto the conveyor 10 so that the container 16 may be conveyed to a suitable discharge station.

While the present disclosure shows a bottle or container depresser or compresser as being a replaceable circular disc that may be of varying diameter, dependent upon the degree to which the container is to be depressed, it is to be understood that such is purely for the purpose of illustration. It becomes readily apparent that a piston and cylinder structure, that is actuated by suitable fluidic means, could be substituted for the circular disc as could any type of plunger that is capable of engaging and compressing a surface of a flexible container for the purpose of raising the level of a fluid in said container during the capping operation. It is to be further noted that a container depresser or squeezer of the aforementioned types could be used without a starwheel being utilized to effect the movement of the containers in their path of travel. The flexible containers could be disposed on a movable conveyor that is designed to carry said container from the filling station to the capping station and at the capping station compressor means could be utilized for depressing a side of the container as the conveyor moves the container through the capping or closure station.

In the use or operation of the present invention the flexible containers 16 are delivered by the conveyor 10 to the in-feed starwheel 18 which engages and moves said containers onto the rotating turret 22 in properly spaced relation to one another. The turret moves the containers into engagement with the filling nozzles, not shown, and the containers are filled with a pre-determined amount of liquid, such as milk, and then are conveyed by the turret to the discharge starwheel 26. Prior to the time that the first several containers 16 reach the starwheel 16 the level or height of the fluid within said containers can be readily ascertained and it can then be determined as to approximately what size of disc member 32 should be mounted on the shaft 28. The proper size disc member can then be placed upon the shaft 28 and the starwheel 26 can then also be placed upon said shaft so as to engage the containers 16 as they are delivered by the rotating turret 22. As the containers are engaged by the starwheel 26 the disc member 32 will also engage a surface of each container for depressing or squeezing said surface to cause the level of the fluid to be elevated to a point adjacent the neck portion 36 of the container. The arcuate shaped guide rail 24 not only facilitates the movement of the containers by the starwheel into and through the cap applying station A but also aids in holding the containers as they are being moved by the starwheel and thus enabling the disc member 32 to compress or squeeze a surface of the container during the entire time that the container is being engaged by the starwheel and moved through the cap applying station A.

As the container moves into the cap applying station the neck portion 36 of the container 36 will engage a cap carried in the cap supply chute 38 and cause said cap to be deposited upon the top of the neck portion 36. As the container continues to move the cap moves under the cap guide member 42 and then between the coacting rollers 44 which rotatably apply the cap 40 to the neck portion 36 of the flexible container 16. The flexible container after being capped is moved by the starwheel 26 onto the discharge conveyor 10 and due to the sealing element within the cap or closure member 40 air is prevented from entering the flexible container 16 so that the level of the fluid within said container is maintained at the height that was created by the depressing of the side of the container by the flat disc member 32 and in this manner all of the containers will have substantially the same fluid level.

Although the foregoing description is necessarily of a detailed character, in order that the invention may be completely set forth, it is to be understood that the specific terminology is not intended to be restrictive or confining, and that various rearrangements of parts and modifications of detail may be resorted to without departing from the scope or spirit of the invention as herein claimed.

I claim:

1. In a cap applying apparatus embodying a conveyor for delivering a plurality of flexible empty containers to a rotary turret and for receiving from said turret a plurality of containers having a predetermined amount of fluid therein, a first station for delivering and loosely positioning caps or closures upon said containers, a second station spaced from said first station for tightening said caps or closures upon said containers, a discharge member positioned between said conveyor and turret for engaging said fluid filled containers and moving them from said turret through both of said stations and onto said conveyor, a disc member associated with said discharge member for engaging a fluid filled container and compressing a surface thereof to raise the level of the fluid therein as said container is moved from the turret through the first and second stations and onto the conveyor by said discharge member, said first station having a cap or closure guide member for engaging each cap or closure to position same upon said container as said container is being moved to said second station by said discharge member.

2. In a cap applying apparatus as set forth in claim 1 wherein said second station includes a pair of spaced coacting rollers for engaging the caps or closures on diametrically opposite sides to secure same upon said containers, said rollers having drive pulleys with means for driving said pulleys.

3. In a cap applying apparatus as set forth in claim 1 wherein a guide member is provided in spaced relation to said discharge member and a platform is interposed between said discharge member and said guide member for receiving the fluid filled containers from said turret as they are moved through said stations and onto said conveyor by said discharge member.

* * * * *